US009358668B2

(12) United States Patent
Hashish et al.

(10) Patent No.: US 9,358,668 B2
(45) Date of Patent: Jun. 7, 2016

(54) FLUID JET RECEIVING RECEPTACLES AND RELATED FLUID JET CUTTING SYSTEMS

(71) Applicant: Ascent Aerospace, LLC, Santa Ana, CA (US)

(72) Inventors: Mohamed A. Hashish, Bellevue, WA (US); Eckhardt R. Ullrich, Kent, WA (US); Michael Knaupp, Zaisenhausen (DE); Steven J. Craigen, Auburn, WA (US); Charles M. Brown, Bellevue, WA (US); Bruce M. Schuman, Auburn, WA (US)

(73) Assignee: Ascent Aerospace, LLC, Santa Ana, CA (US)

( * ) Notice: Subject to any disclaimer, the term of this patent is extended or adjusted under 35 U.S.C. 154(b) by 460 days.

(21) Appl. No.: 13/782,916

(22) Filed: Mar. 1, 2013

(65) Prior Publication Data

US 2014/0024295 A1 Jan. 23, 2014

Related U.S. Application Data

(60) Provisional application No. 61/673,585, filed on Jul. 19, 2012.

(51) Int. Cl.

| | |
|---|---|
| ***B24C 9/00*** | (2006.01) |
| ***B24C 5/02*** | (2006.01) |
| ***B26F 3/00*** | (2006.01) |

(52) U.S. Cl.

CPC ... *B24C 9/00* (2013.01); *B24C 5/02* (2013.01); *B26F 3/008* (2013.01)

(58) Field of Classification Search

CPC .... B23Q 11/0046; B24B 55/12; B24C 1/045; B24C 3/04; B24C 3/065; B24C 3/18; B24C 3/22; B24C 9/00; B24C 9/003; B24C 9/006; B26F 3/008

See application file for complete search history.

(56) References Cited

U.S. PATENT DOCUMENTS

| | | | | |
|---|---|---|---|---|
| 2,039,695 | A | 5/1936 | Watt | |
| 2,462,480 | A | 2/1949 | Eppler | |
| 2,985,050 | A | 5/1961 | Schwacha | |
| 3,041,906 | A * | 7/1962 | Gilman | B21D 28/007 83/167 |
| 3,730,040 | A | 5/1973 | Chadwick et al. | |
| 3,818,774 | A | 6/1974 | Schnekenburger et al. | |
| 4,207,710 | A | 6/1980 | Fournier | |
| 4,435,902 | A | 3/1984 | Mercer et al. | |

(Continued)

FOREIGN PATENT DOCUMENTS

| | | | |
|---|---|---|---|
| DE | 19618523 | A1 | 11/1997 |
| WO | 2011/046142 | A1 | 4/2011 |

*Primary Examiner* — Timothy V Eley

(74) *Attorney, Agent, or Firm* — The Weintraub Group, P.L.C.

(57) ABSTRACT

A jet receiving receptacle is provided which is coupleable to a high-pressure fluid jet system opposite a nozzle thereof to receive a fluid jet discharged from the nozzle after it acts on a workpiece. The jet receiving receptacle may include an elongated inlet alignable with a direction of travel of the nozzle to receive the fluid jet in a deflected state. The jet receiving receptacle may further include a jet deflection device positioned downstream of the elongated inlet to redirect at least a portion of the fluid jet and a jet rebound device located upstream of the jet deflection device to be impinged on by the redirected portion of the fluid jet. The jet deflection device and jet rebound device may form, in combination with a housing, a device to trap the fluid jet. Fluid jet cutting systems incorporating a jet receiving receptacle and related methods are also provided.

30 Claims, 7 Drawing Sheets

(56) References Cited

U.S. PATENT DOCUMENTS

| | | | | |
|---|---|---|---|---|
| 4,532,949 | A | 8/1985 | Frank | |
| 4,589,234 | A | 5/1986 | Rebhan et al. | |
| 4,646,482 | A | 3/1987 | Chitjian | |
| 4,651,476 | A | 3/1987 | Marx et al. | |
| 4,665,949 | A | 5/1987 | Jordan | |
| 4,669,229 | A | 6/1987 | Ehlbeck | |
| 4,698,939 | A | 10/1987 | Hashish | |
| 4,758,284 | A | 7/1988 | Todd | |
| 4,799,415 | A | 1/1989 | Gerdes | |
| 4,827,679 | A | 5/1989 | Earle, III | |
| 4,848,042 | A | 7/1989 | Smith et al. | |
| 4,862,649 | A * | 9/1989 | Davis | B24C 7/0076 406/169 |
| 4,864,780 | A * | 9/1989 | Ehlbeck | B26F 3/008 451/38 |
| 4,872,293 | A * | 10/1989 | Yasukawa | B24C 1/045 451/75 |
| 4,920,841 | A | 5/1990 | Johnson | |
| 4,937,985 | A | 7/1990 | Boers et al. | |
| 4,955,164 | A | 9/1990 | Hashish et al. | |
| 4,964,244 | A | 10/1990 | Ehlbeck | |
| 5,092,744 | A | 3/1992 | Boers et al. | |
| 5,111,652 | A | 5/1992 | Andre | |
| 5,445,557 | A | 8/1995 | Gramm et al. | |
| 5,527,204 | A | 6/1996 | Rhoades | |
| 5,643,058 | A | 7/1997 | Erichsen et al. | |
| 5,826,813 | A | 10/1998 | Hibata | |
| 5,831,224 | A | 11/1998 | Wattles et al. | |
| 5,980,372 | A | 11/1999 | Spishak | |
| 6,332,833 | B1 | 12/2001 | Ohshima et al. | |
| 6,500,058 | B2 | 12/2002 | Bajo et al. | |
| 6,524,171 | B2 | 2/2003 | Voutilainen | |
| 6,719,611 | B2 * | 4/2004 | Kordonski | B24B 13/0025 451/36 |
| 6,746,309 | B2 | 6/2004 | Tsuihiji et al. | |
| 6,766,216 | B2 | 7/2004 | Erichsen et al. | |
| 7,000,513 | B2 | 2/2006 | Zelinski, Jr. et al. | |
| 7,052,378 | B2 * | 5/2006 | Tateiwa | B24C 7/0007 451/453 |
| 7,059,940 | B2 | 6/2006 | Seo et al. | |
| 7,389,663 | B2 | 6/2008 | Cheppe et al. | |
| 7,695,348 | B2 | 4/2010 | Mase | |
| 8,322,700 | B2 | 12/2012 | Saberton et al. | |
| 2002/0090897 | A1 | 7/2002 | Jinbu et al. | |
| 2003/0019340 | A1 | 1/2003 | Shaw | |
| 2007/0028735 | A1 * | 2/2007 | Brodbek | B26D 7/20 83/98 |
| 2007/0238393 | A1 | 10/2007 | Shin et al. | |
| 2008/0032610 | A1 | 2/2008 | Chacko et al. | |
| 2008/0242200 | A1 | 10/2008 | Okada et al. | |
| 2009/0098810 | A1 | 4/2009 | Mase | |
| 2009/0140482 | A1 | 6/2009 | Saberton et al. | |
| 2009/0318064 | A1 | 12/2009 | Hashish | |
| 2012/0184185 | A1 | 7/2012 | Kanazawa et al. | |
| 2013/0025425 | A1 | 1/2013 | Knaupp et al. | |
| 2014/0030963 | A1 * | 1/2014 | Kanazawa | B24C 9/00 451/87 |

* cited by examiner

FLUID JET RECEIVING RECEPTACLES AND RELATED FLUID JET CUTTING SYSTEMS

BACKGROUND

1. Technical Field

This disclosure is related to fluid jet cutting systems and devices, and, in particular, to compact fluid jet receiving receptacles which are positionable to catch a fluid jet discharged from a cutting head of a fluid jet cutting system during workpiece processing operations.

2. Description of the Related Art

Fluid jet or abrasive-fluid jet cutting systems are used for cutting a wide variety of materials, including stone, glass, ceramics and metals. In a typical fluid jet cutting system, a high-pressure fluid (e.g., water) flows through a cutting head having a cutting nozzle that directs a cutting jet onto a workpiece. The system may draw or feed an abrasive into the high-pressure fluid jet to form an abrasive-fluid jet. The cutting nozzle may then be controllably moved across the workpiece to cut the workpiece as desired. After the fluid jet, or abrasive-fluid jet, generically referred to hereinafter as a "waterjet," passes through the workpiece, the energy of the waterjet is often dissipated by a relatively large volume of water in a catcher tank that is also configured to support the workpiece. Systems for generating high-pressure waterjets are currently available, such as, for example, the Mach 4™ five-axis waterjet system manufactured by Flow International Corporation, the assignee of the present application. Other examples of waterjet cutting systems are shown and described in Flow's U.S. Pat. No. 5,643,058, which is incorporated herein by reference in its entirety. Examples of catcher tank systems for supporting workpieces and dissipating energy of a waterjet after it passes through a workpiece are shown and described in Flow's U.S. patent application Ser. No. 13/193,435, filed Jul. 28, 2011, which is incorporated herein by reference in its entirety.

Although many waterjet cutting systems feature a catcher tank arrangement having a large volume of water contained therein to dissipate energy of the waterjet during use, other known systems utilize compact fluid jet receiving receptacles which are positioned opposite a cutting head and moved in unison with the same to catch the jet after it is discharged from the cutting head and acts on a workpiece. Examples of such receptacles (also referred to as "catcher cups") and other related devices are shown and described in U.S. Pat. Nos. 4,435,902; 4,532,949; 4,651,476; 4,665,949; 4,669,229; 4,698,939; 4,799,415; 4,920,841; and 4,937,985. Known fluid jet receiving receptacles, however, can suffer from several drawbacks. For example, many fluid jet receiving receptacles are overly complex, bulky and/or prone to premature wear. In addition, many known fluid jet receiving receptacles are configured such that upon wear, fluid and abrasives from the jet may rebound from the receptacle and cause surface defects in the workpiece, excessive noise and/or other hazardous or unwanted conditions.

BRIEF SUMMARY

Embodiments described herein provide fluid jet receiving receptacles and waterjet cutting systems incorporating the same and related methods which are particularly well adapted for receiving a jet during workpiece processing. Other benefits include passing the jet through an elongated inlet aligned in the direction of travel to enable the receptacle to receive a jet in a deflected state while minimizing or substantially reducing or preventing rebounding of the jet out of the receptacle and onto a surface of the workpiece. Embodiments include a jet receiving receptacle having an elongated inlet and a trap arrangement, which is coupleable to a high-pressure fluid jet system opposite a nozzle thereof to receive and trap a fluid jet discharged from the nozzle in a particularly compact form factor or package.

According to some embodiments, a fluid jet system adapted to generate a fluid jet under high-pressure operating conditions to process a workpiece may be summarized as including a cutting head having a nozzle to discharge the fluid jet and a jet receiving receptacle positioned opposite the nozzle to receive the fluid jet during a workpiece processing operation. The jet receiving receptacle may include an elongated inlet (e.g., oval, rectangular) aligned with a direction of travel of the nozzle to receive the fluid jet from the nozzle in a deflected state during the workpiece processing operation. The jet receiving receptacle may further include a jet deflection device positioned downstream of the elongated inlet to receive and redirect a portion of the fluid jet to impinge on a jet rebound device positioned upstream of the jet deflection device during the workpiece processing operation. The jet rebound device and the jet deflection device may form opposing ends of a chamber to trap contents of the fluid jet and route the contents of the fluid jet away from the jet receiving receptacle during the workpiece processing operation. The jet receiving receptacle may be configured to be manipulated in space in unison with the nozzle such that the elongated inlet is aligned with the direction of travel of the nozzle to receive the fluid jet from the nozzle in the deflected state during the workpiece processing operation.

The jet receiving receptacle may further include a housing with an internal cavity and a discharge port. The jet deflection device, the jet rebound device and the internal cavity of the housing may be configured to collectively trap contents of the fluid jet and route the contents of the fluid jet away from the jet receiving receptacle through the discharge port during the workpiece processing operation. The jet receiving receptacle may be coupled to move in unison with the nozzle by a rigid support arm and the rigid support arm may be shaped to define a workpiece clearance envelope between the nozzle and the jet receiving receptacle. The jet receiving receptacle may be configured to couple and move in unison with the nozzle in at least two primary orientations to facilitate processing workpieces with the elongated inlet in a first cutting orientation and alternatively with the elongated inlet in a second cutting orientation perpendicular to the first cutting orientation.

In some instances, the jet deflection device and the jet rebound device may be one or more planar structures having a material hardness equal to or greater than a hardness of tungsten carbide. In other embodiments, the jet rebound device may include at least one planar structure made of steel or aluminum. The jet deflection device may be removably coupled to the housing to enable removal and replacement of the jet deflection device from a downstream end of the housing and the jet rebound device may be removably coupled to the housing to enable removal and replacement of the jet rebound device from an upstream end of the housing.

In some instances, the jet rebound device may comprise a series of baffles spaced apart from each other in regular or irregular intervals. In some embodiments, each of the series of baffles may comprise a material that is softer than a material of the jet deflection device. Each baffle of the series of baffles may include an elongated aperture to generally align with the elongated inlet of the jet receiving receptacle. An initial profile of the elongated aperture of each baffle may be within a profile of the elongated inlet of the jet receiving receptacle projected in a downstream direction. An initial width of the elongated aperture of each baffle may be at least ten percent less than a width of a cross-sectional profile of the narrowest portion of the elongated inlet of the jet receiving receptacle. Each baffle may be readily removable from the jet receiving receptacle. For example, each baffle may be slidably removable from the jet receiving receptacle from an exterior thereof.

In some instances, the jet receiving receptacle may include an inlet feed component separate from and removably coupled to the housing. At least a portion of the elongated inlet of the jet receiving receptacle may be defined by an aperture of the inlet feed component. At least a portion of the aperture of the inlet feed component may generally narrow or taper in a downstream direction to funnel the fluid jet during the workpiece processing operation. In some instances, a portion of the housing may form the elongated inlet of the jet receiving receptacle, a portion of the jet deflection device and/or the jet rebound device.

A breakthrough detector port may be provided downstream of the jet deflection device to sense a condition in which the fluid jet breaks through the jet deflection device.

According to other embodiments, a method of capturing a fluid jet generated by a high-pressure fluid jet system may be summarized as including: discharging a fluid jet from a nozzle of the high-pressure fluid system through a workpiece while moving the nozzle in a first direction such that the fluid jet deflects in response to moving through the workpiece; and passing the deflected fluid jet through an inlet of a jet receiving receptacle to impinge on a jet deflection device provided in the jet receiving receptacle to redirect at least a substantial portion of the fluid jet to impinge on a jet rebound device positioned in the jet receiving receptacle upstream of and generally opposite the jet deflection device. The method may further include trapping the contents of the deflected fluid jet between the jet deflection device and jet rebound device and routing the trapped contents of the deflected fluid jet away from the jet receiving receptacle. Passing the deflected fluid jet through the inlet of the jet receiving receptacle may include passing the deflected fluid jet through the inlet of the jet receiving receptacle to impinge on the jet deflection device such that at least a majority of the fluid jet is redirected to impinge on the jet rebound device. Passing the deflected fluid jet through the inlet of the jet receiving receptacle may include passing the deflected fluid jet through an elongated inlet that is substantially aligned with the first direction. The inlet of the jet receiving receptacle may be elongated and the method may further include manipulating the jet receiving receptacle in space in unison with the nozzle of the high-pressure fluid jet system such that the elongated inlet of the jet receiving receptacle is aligned with the direction of travel of the nozzle to receive the fluid jet from the nozzle in the deflected state.

DETAILED DESCRIPTION

Figure 1:
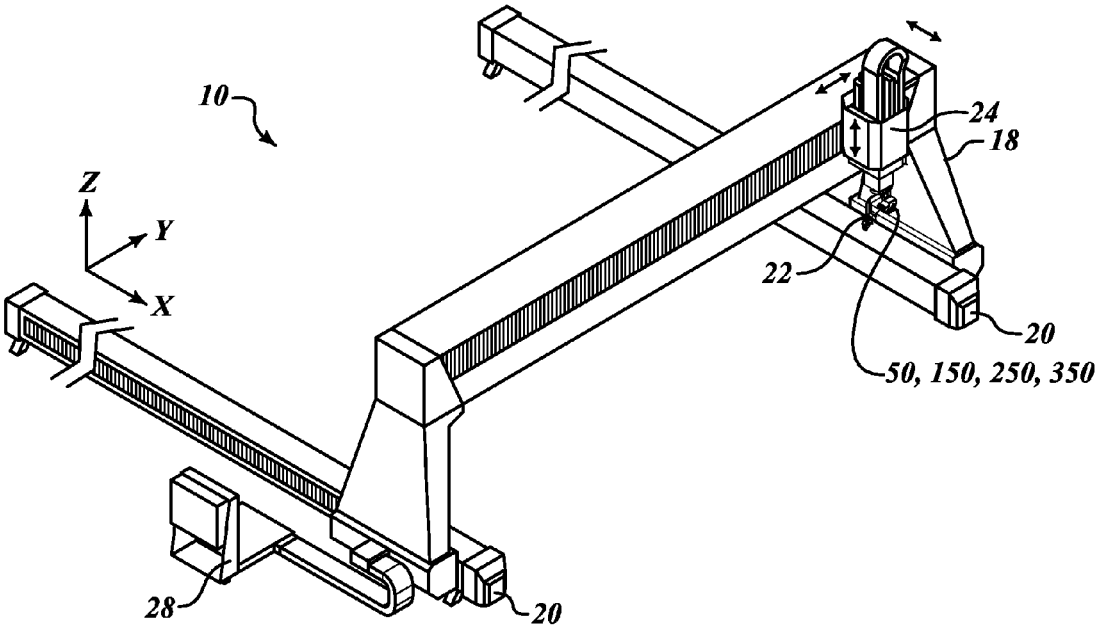
FIG. 1 is an isometric view of a waterjet cutting system, according to one embodiment, having a waterjet cutting head positioned opposite a fluid jet receiving receptacle.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet cutting systems and methods of operating the same may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the waterjet systems described herein to facilitate, for example, high-pressure or ultrahigh-pressure abrasive waterjet cutting of workpieces. As another example, well know control systems and drive components may be integrated into the waterjet cutting systems to facilitate movement of the cutting head relative to the workpiece to be processed. These systems may include drive components to manipulate the cutting head about multiple rotational and translational axes, as is common in five-axis abrasive waterjet cutting systems, for example. Example waterjet systems may include waterjet cutting heads coupled to a gantry-type motion system or a robotic arm motion system.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide fluid jet receiving receptacles and waterjet cutting systems incorporating the same and related methods which are particularly well adapted for receiving a high-pressure fluid jet during workpiece processing in a deflected state and trapping the contents of the fluid jet from rebounding out of the receptacle. Embodiments include a jet receiving receptacle having an elongated inlet aligned with a direction of travel of the nozzle to receive the fluid jet from the nozzle in a deflected state. The jet receiving receptacle further includes a jet deflection device positioned downstream of the elongated inlet to receive and redirect a portion of the fluid jet to impinge on a jet rebound device positioned upstream of the jet deflection device. The jet deflection device and the jet rebound device may be positioned relatively close to each other and may be configured to trap the fluid jet therebetween and route the fluid downstream away from the inlet.

As described herein, the term cutting head may refer generally to an assembly of components at a working end of the waterjet cutting machine or system, and may include, for example, a nozzle of the waterjet cutting system for generating a high-pressure waterjet and surrounding structures and devices coupled directly or indirectly thereto to move in unison therewith. The cutting head may also be referred to as an end effector.

FIG. 1 shows an example embodiment of a waterjet cutting system 10. The waterjet cutting system 10 may operate in the vicinity of a support structure (not shown) which is configured to support a workpiece 14 (FIGS. 3 and 7) to be processed by the system 10. The support structure may be a rigid structure or a reconfigurable structure suitable for supporting one or more workpieces 14 (e.g., composite aircraft parts) in a position to be cut, trimmed or otherwise processed. Examples of suitable workpiece support structures include those shown and described in Flow's U.S. application Ser. No. 12/324,719, filed Nov. 26, 2008, and published as US 2009/0140482, which is incorporated herein by reference in its entirety.

The waterjet cutting system 10 further includes a bridge assembly 18 which is movable along a pair of base rails 20. In operation, the bridge assembly 18 moves back and forth along the base rails 20 with respect to a translational axis X to position a cutting head 22 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22 along yet another translational axis Z to move the cutting head 22 toward and away from the workpiece 14. One or more manipulable links or members may also be provided intermediate the cutting head 22 and the tool carriage 24 to provide additional functionally.

For example, the system 10 may include a forearm rotatably coupled to the tool carriage 24 for rotating the cutting head 22 about a first axis of rotation and a wrist rotatably coupled to the forearm to rotate the cutting head 22 about another axis of rotation that is non-parallel to the aforementioned rotational axis. In combination, the rotational axes of the wrist and forearm can enable the cutting head 22 to be manipulated in a wide range of orientations relative to the workpiece 14 to facilitate, for example, cutting of complex profiles. The rotational axes may converge at a focal point which, in some embodiments, may be offset from the end or tip of a nozzle 40 of the cutting head 22. The end or tip of the nozzle 40 of the cutting head 22 is preferably positioned at a desired standoff distance from the workpiece 14 to be processed. The standoff distance may be selected or maintained at a desired distance to optimize the cutting performance of the waterjet.

During operation, movement of the cutting head 22 with respect to each of the translational axes X, Y, Z and one or more rotational axes A (FIG. 2) may be accomplished by various conventional drive components and an appropriate control system 28 (FIG. 1). Example control methods and systems for waterjet cutting machines, which include, for example, CNC functionality, are described in Flow's U.S. Pat. No. 6,766,216, which is incorporated herein by reference in its entirety. In general, computer-aided manufacturing (CAM) processes may be used to efficiently drive or control a cutting head of a waterjet cutting machine along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a waterjet cutting machine to manipulate the cutting head about various translational and/or rotary axes to cut or process a workpiece as reflected in the CAD model.

Other well known systems associated with waterjet cutting systems may also be provided such as, for example, a high-pressure or ultrahigh-pressure fluid source (e.g., direct drive and intensifier pumps with pressure ratings ranging from 40,000 psi to 100,000 psi and higher) for supplying high-pressure or ultrahigh-pressure fluid to the cutting head 22 and/or an abrasive source (e.g., abrasive hopper and distribution system) for feeding abrasives to the cutting head 22 to enable abrasive waterjet cutting. In some embodiments, a vacuum device may be provided to assist in drawing abrasives into the fluid from the fluid source to produce a consistent abrasive fluid jet to enable particularly accurate and efficient workpiece processing. Details of the control system, conventional drive components and other well known systems associated with waterjet cutting systems, however, are not shown or described in detail to avoid unnecessarily obscuring descriptions of the embodiments.

Furthermore, although the example waterjet cutting system 10 of FIG. 1 is shown as including a bridge assembly 18 or gantry-type motion system, it will be appreciated that embodiments of the fluid jet receiving receptacle devices described herein may be used in connection with many different known motion systems, including, for example, robotic arms which may be manipulated about numerous rotational and/or translational axes to position a cutting head and an associated fluid jet receiving receptacle in a wide range of positions and orientations. Still further, in some instances, the waterjet cutting systems may feature a stationary cutting head wherein a workpiece is manipulated beneath a nozzle thereof and wherein a fluid jet receiving receptacle is mounted opposite the nozzle.

Figure 2:
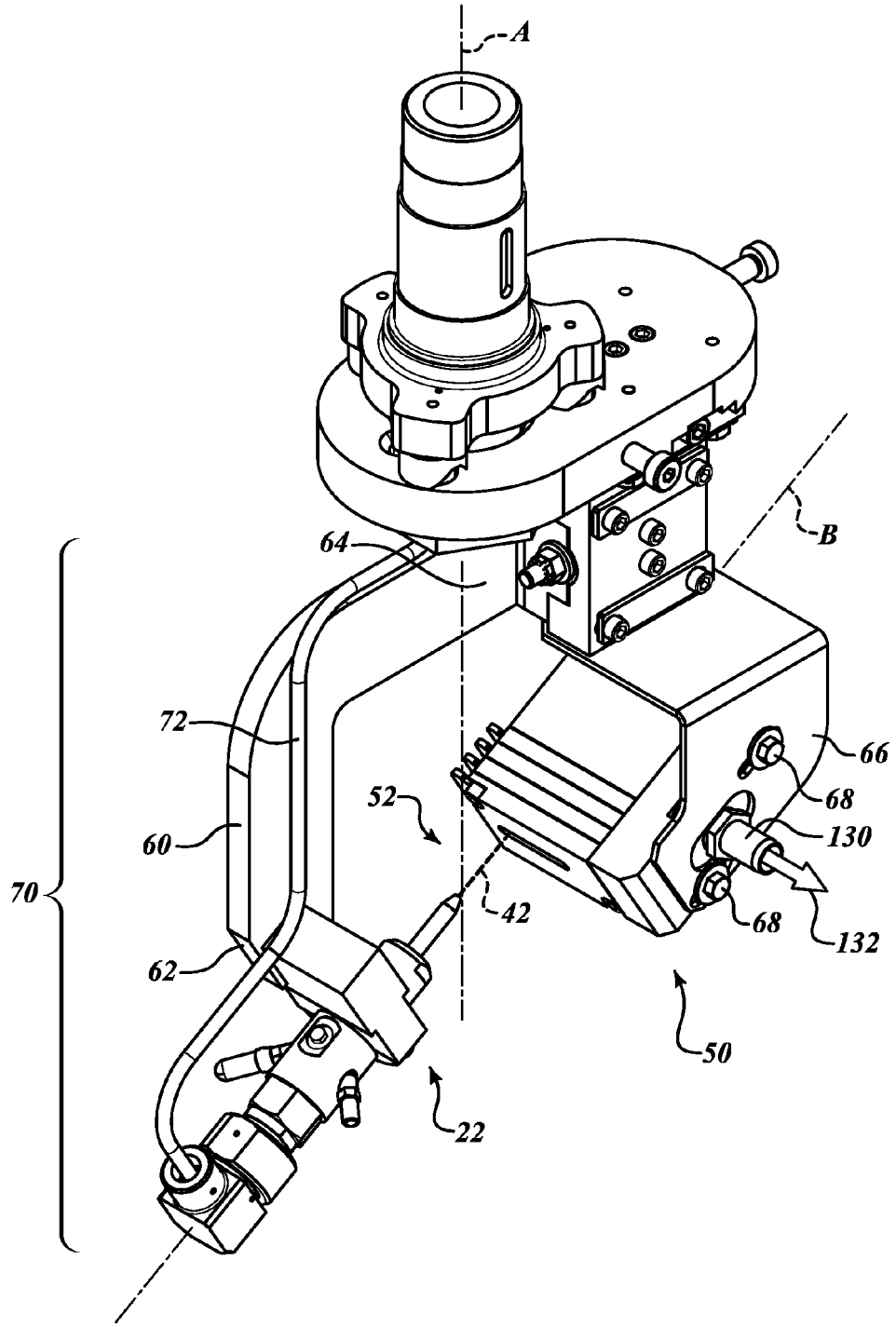
FIG. 2 is an isometric view of a fluid jet receiving receptacle, according to one embodiment, coupled to and positioned opposite a waterjet cutting head of the waterjet cutting system of FIG. 1.

With reference to FIG. 2, the nozzle 40 may protrude from a working end of the cutting head 22. As is typical of conventional waterjet cutting systems, the nozzle 40 may include an orifice (not shown), such as a jewel orifice, through which fluid passes during operation to generate a fluid jet for processing a workpiece 14. A fluid jet receiving receptacle 50, according to one example embodiment, is coupled to the cutting head 22 to move in unison therewith during cutting or other processing operations. The jet receiving receptacle 50 is held offset from an end of the nozzle 40 to provide a clearance envelope 52 to receive a workpiece 14 (FIGS. 3 and 7) between the nozzle 40 and the jet receiving receptacle 50. In some embodiments, for example, the jet receiving receptacle 50 may be held by a rigid support arm 60 in which one end 62 of the arm 60 is attached to the cutting head 22 and the other end 64 of the arm 60 is attached to the jet receiving receptacle 50. The end 64 of the arm 60 attached to the jet receiving receptacle 50 may be attached to the jet receiving receptacle 50, for example, by way of a bracket 66 or other intermediate structure, as shown in FIG. 2. The jet receiving receptacle 50 may be attached to the bracket 66 by fasteners 68 engaging threaded holes on a mounting face of the receptacle 50. The jet receiving receptacle 50 may be configured to couple to and move in unison with the cutting head 22 in at least two different orientations to facilitate processing workpieces in different primary directions. For example, the receptacle 50 may be coupled to the cutting head 22 in a first orientation for cutting fore and aft and a second orientation for cutting up and down.

The cutting head 22, support arm 60 and jet receiving receptacle 50 may define a generally rigid cutting head assembly 70 during operation. The rigid support arm 60 may be shaped to provide a relatively large clearance envelope 52 to facilitate the processing of workpieces 14 having protruding flanges or other features which might otherwise interfere with the cutting head assembly 70 during workpiece processing operations. Conveniently, the arm 60 may also facilitate routing of various conduits or other devices for enabling certain functionality of the systems 10 described herein. For example, fluid conduits 72 may be routed within or along the arm 60 to respective fittings or adapters on the cutting head 22 to supply fluid and/or abrasives to the cutting head 22 during operation.

Figure 3:
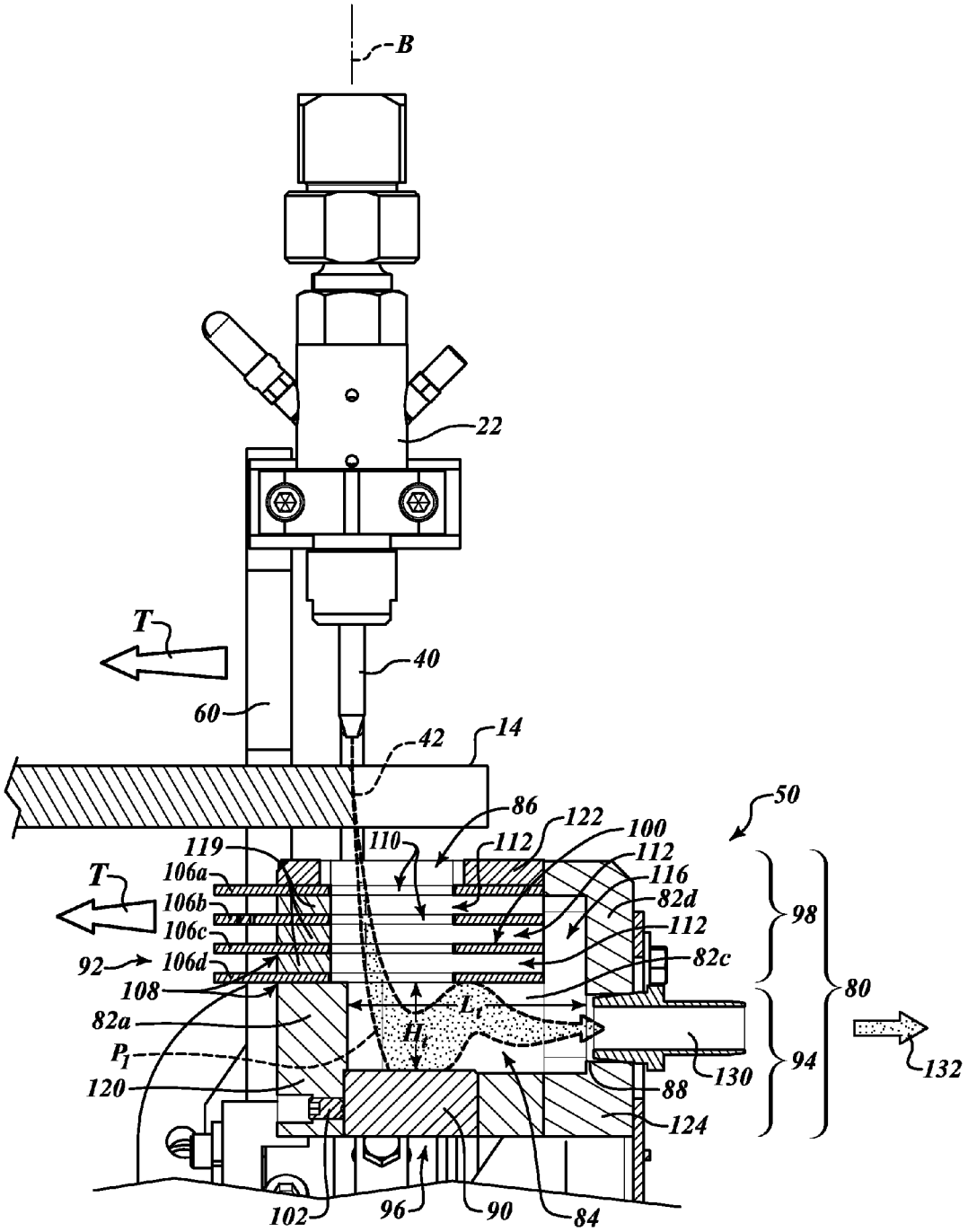
FIG. 3 is a cross-sectional view of the fluid jet receiving receptacle of FIG. 2 taken along line 3-3 with a workpiece positioned between the fluid jet receiving receptacle and a nozzle of the cutting head.
Figure 4:
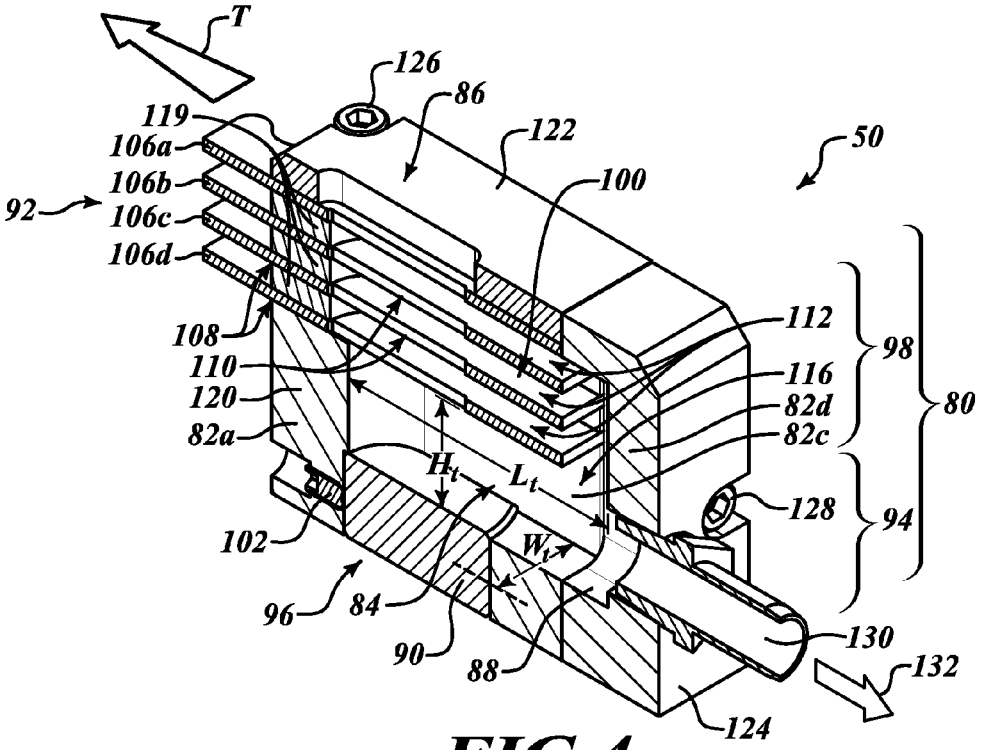
FIG. 4 is an isometric cross-sectional view of the fluid jet receiving receptacle of FIG. 3 taken along line 4-4 and shown isolated from the waterjet cutting system of FIG. 1.

Further details of the jet receiving receptacle 50 will now be provided with reference to FIGS. 3 and 4. As shown best in FIG. 4, the jet receiving receptacle 50 may include a housing 80 having sidewalls 82*a-d* and an internal cavity 84. An inlet 86 is provided within the housing 80 to provide access into the interior cavity 84. The inlet 86 may be elongated with respect to a direction of travel T of the cutting head 22 and jet receiving receptacle 50 in embodiments wherein the workpiece 14 is supported in a static manner and the cutting head 22 and jet receiving receptacle 50 are manipulated in space relative thereto.

In some embodiments, the inlet 86 comprises an elongated aperture, such as, for example, a slender, elongated oval or rectangular shaped aperture, which allows a jet 42 discharged from the nozzle 40 of the cutting head 22 to enter into the housing 80 in an initial state which is generally collinear with the nozzle 40 and also in a deflected state which is caused by passing through the workpiece 14 during processing operations while the cutting head 22 moves in the direction of travel T. In some embodiments, the inlet 86 of the jet receiving receptacle 50 has a cross-sectional inlet profile that is oval with a major axis of the cross-sectional inlet profile being at least fifty percent greater than a minor axis of the cross-sectional inlet profile. The inlet 86 may be slightly wider than the jet 42 to enable the jet to enter into the housing 80 unobstructed while assisting in the prevention or reduction of spray back or splash back. In other instances, the inlet may be formed in whole or part by the jet 42 cutting, eroding or otherwise acting on the housing 80, or components supported thereby, during an initial break-in period.

The jet receiving receptacle 50 may be coupled to the cutting head 22 such that an axis B of the nozzle 40 is aligned to a leading end of the inlet 86. Accordingly, during operation, a fluid jet 42 may enter the inlet 86 at the leading end in a non-deflected state and fan out toward an opposing end of the inlet 86 in a deflected state when the jet 42 cuts a workpiece 14 while moving in the travel direction T. The jet receiving receptacle 50 may be manipulated in space in unison with the nozzle 40 such that the inlet 86 is maintained in general alignment with the travel direction T of the nozzle 40 to receive the fluid jet 42 from the nozzle 40 in the deflected state throughout a cutting operation. The amount of deflection of the jet 42 will depend on a variety of factors, including in particular the speed of the travel and the material being cut in terms of thickness and hardness, among other properties.

An outlet passage or discharge port 88 is also provided within the housing 80 to enable contents of the jet 42 captured by the jet receiving receptacle 50 to be routed out of the housing 80 to be discarded, recycled and/or reused as desired. In the embodiment of the jet receiving receptacle 50 shown in FIGS. 3 and 4, the discharge port 88 is located on one of the sidewalls 82*d*. More particularly, the discharge port 88 is located on a sidewall 82*d* which is on the trailing side of the fluid jet receiving receptacle 50 with respect to the direction of travel T. Although only a single discharge port 88 is shown in FIGS. 3 and 4, in other embodiments, more than one discharge port 88 may be provided in one or more sidewalls 82*a-d* and used separately or simultaneously to route the contents of the captured jet 42 away from the jet receiving receptacle 50.

With continued reference to FIGS. 3 and 4, the housing 80 is configured to support a jet deflection device 90 downstream of the inlet 86 to receive and redirect a portion of the incoming jet 42 to impinge on a jet rebound device 92 upstream of the jet deflection device 90 during the workpiece processing operation. For this purpose, the housing 80 may include a lower housing portion 94 with a cavity 96 to receive and rigidly support the jet deflection device 90 and an upper housing portion 98 with a cavity 100 to receive and rigidly support the jet rebound device 92.

For example, as shown in FIGS. 3 and 4, the lower housing portion 94 may be provided with a cavity 96 that is sized and shaped to receive a jet deflection device 90 in the form of a planar structure, such as, for example, a planar disc. The jet deflection device 90 may be removably coupled within the cavity 96 of the lower housing portion 94, such as, for example, by a set screw 102 or other device. In this manner, the jet deflection device 90 may be conveniently removed from the housing 80 and replaced when the jet deflection device 90 becomes excessively worn from the jet 42 impinging thereon. The sidewalls 82*a-d* of the housing 80 may provide a limit or stop for the jet deflection device 90 when installed in the housing 80. In some embodiments, the jet deflection device 90 may comprise tungsten carbide or materials of comparable or greater hardness to prolong the life of the jet deflection device 90. Accordingly, in some embodiments, the jet deflection device 90 may have a material hardness equal to or greater than a hardness of tungsten carbide (~9 Mohs scale, 1700-2400 Vickers number).

As shown in FIGS. 3 and 4, the upper housing portion 98 may be provided with a cavity 100 that is adapted to receive or otherwise house a jet rebound device 92 in the form of a series of baffles 106*a-d*. The baffles 106*a-d* may be removably coupled to the upper housing portion 98, such as, for example, by insertion into a series of accordingly sized and shaped receiving slots or compartments 108. In this manner, the baffles 106*a-d* may be conveniently removed, individually or collectively, from the housing 80 and replaced when the baffles 106*a-d* become excessively worn from the jet 42 passing through the baffles 106*a-d* and/or rebounding onto the baffles 106*a-d* after deflecting off the jet deflection device 90.

In some instances, the series of baffles 106*a-d* may be slidably removable from the fluid jet receiving receptacle 50 from an exterior thereof. The sidewalls 82*a-d* of the housing 80 may provide a limit or stop for the baffles 106*a-d* when installed in the housing 80. In some embodiments, the baffles 106*a-d* may comprise a material that is softer than the jet deflection device 90 which deflects the incoming jet to impinge on the baffles 106*a-d*. For instance, the baffles 106*a-d* may comprise aluminum or steel and the jet deflection device 90 may comprise tungsten carbide or other materials of greater hardness.

With continued reference to FIGS. 3 and 4, each of the baffles 106*a-d* may include a jet aperture 110 which may be sized and shaped similar to the inlet 86 to enable the jet 42 to pass therethrough with little or no obstruction while simultaneously shielding the contents of the jet 42 from rebounding back upstream and out of the fluid jet receiving receptacle 50. In some embodiments, the jet aperture 110 is pre-formed in each baffle 106*a-d*. In other embodiments, the jet aperture 110 of each baffle 106*a-d* may be formed by the jet 42 during an initial stage of processing or an initial break-in period. In some embodiments, an initial profile of the jet aperture 110 of each baffle 106*a-d* is within a profile of the inlet 86 of the jet receiving receptacle 50 projected in a downstream direction. In some embodiments, an initial width of the jet aperture 110 of each baffle 106*a-d* is at least ten percent less than a width of the narrowest cross-sectional profile of the inlet 86 of the jet receiving receptacle 50.

The baffles 106*a-d* may be spaced apart from each other, in regular or irregular intervals, to create a series of compartments or chambers 112 within the upper housing portion 98 which may advantageously muffle or reduce operational noises and also assist in the minimization or prevention of spray back or splash back. The baffles 106*a-d* may terminate short of the trailing sidewall 82*d* of the jet receiving receptacle 50 such that the chambers 112 are in fluid communication with a common space 116 between the series of baffles 106*a-d* and the sidewall 82*d*. This may facilitate routing contents of the jet 42 that may be trapped in the chambers 112 toward the common space 116 and ultimately to the discharge port 88.

With reference to FIGS. 3 and 4, the downstream baffle 106*d* is generally parallel to and offset from the jet deflection device 90 to create, in combination with the sidewalls 82*a-d* of the housing 80, a trap to receive the jet 42 discharged from the nozzle 40 during a workpiece processing operation. A representative path $P_1$ of the jet 42 through the trap is shown in FIG. 3. The path $P_1$ illustrates the nature of the jet 42 being in a deflected state as it exits from the workpiece 14, enters the inlet 86 and passes through the jet apertures 110 in the baffles 106*a-d* and moves toward the trap. After passing through the baffles 106*a-d*, the jet 42 impacts the jet deflection device 90 and is deflected such that a substantial portion or a majority of the contents of the jet 42 move back toward the upper housing portion 98 to impinge predominately on the downstream baffle 106*d* which is positioned upstream of the jet deflection device 90. The structure of the downstream baffle 106*d*, however, substantially prevents the jet from continuing toward the inlet 86 and instead diverts the deflected jet generally away from the inlet 86 for eventual discharge through the discharge port 88. In some embodiments, a substantial portion or a majority of the contents of the jet 42 is deflected by the jet deflection device 90 to impinge directly on the jet rebound device 92 without encountering any intermediate structures. In some embodiments, a substantial portion or a majority of the contents of the jet 42 is deflected by the jet deflection device 90 to impinge directly on the jet rebound device 92 in the vicinity of the jet aperture 110 of the downstream baffle 106*d*.

It will be appreciated by those of ordinary skill in the relevant art that references to upstream and downstream in the descriptions above are used generally to indicate direction relative to the incoming jet 42 which is initially discharged from the nozzle 40 in alignment with axis B, shown in FIG. 3. Downstream thus corresponds generally to the direction of the discharged jet 42 moving away from the inlet 86 along axis B, and upstream corresponds to the opposite direction. It will be further understood, however, that upstream and downstream are relative positional terms which depend on a path of flowing fluid, with upstream being nearer the source of the fluid and downstream being farther from the source.

In some embodiments, the height $H_t$ of the trap formed between the downstream baffle 106*d* and the jet deflection device 90 is less than a length $L_t$ of the trap. In addition, the width $W_t$ of the trap may be less than the length $L_t$ of the trap. In some embodiments, both the height $H_t$ and the width $W_t$ of the trap are at least thirty percent less than the length $L_t$ of the trap, thereby defining a generally elongated trap. The trap may be elongated in the direction from a leading sidewall 82*a* of the jet receiving receptacle 50 to the trailing sidewall 82*d*. In some instances, the trap may form a slender, elongated, generally rectangular volume or an oval column which is elongated in the travel direction T. Irrespective of the particular size and shape of the trap, however, the trap provides wear structures (i.e., the jet deflection device 90 and the jet rebound device 92) on opposing ends of a chamber which collectively catch substantially the entirety of the contents of the fluid jet 42 in a relatively confined space and route the contents toward the discharge port 88. According to some embodiments, the trap may be vacant with the exception of the contents of the jet 42. In other embodiments, jet arresting or energy dissipating devices (not shown) may be provided within the trap to further dissipate the energy of the incoming jet 42 prior to discharge from the jet receiving receptacle 50.

The housing 80 of the jet receiving receptacle 50 may comprise a plurality of separately joinable housing components. For instance, as shown in the example embodiment of FIGS. 3 and 4, the housing 80 may comprise three primary components and a series of spacers 119 which join together to define the internal cavity 84 and to support the jet deflection device 90 and jet rebound device 92 therein. More particularly, a main body component 120, a cover element 122, a side cap 124 and the series of spacers 119 may be joined together with one or more fasteners 126, 128 or other devices. The main body component 120 and spacers 119 may be coupled together to define or include a series of slots or other receiving features for removably supporting the baffles 106*a-d*. The cover element 122 may include the inlet 86 formed therein and may be removably coupled to the spacers 119 and main body component 120 to provide access to the internal cavity 84. The side cap 124 may enclose the trailing end of the receptacle 50 and sealingly engage the cover element 122, the main body component 120 and spacers 119 to complete the housing 80. The side cap 124 may include the discharge port 88 and a threaded connection or other coupling feature to receive a discharge fitting or adapter 130 to couple the housing 80 to a discharge conduit (not shown) for routing the contents of the fluid jet away from the receptacle 50, as represented by the arrow labeled 132. It is appreciated, however, that in other embodiments, the housing 80 may include more or fewer components. For instance, in some embodiments, the housing 180 may be cast or otherwise formed as a single unitary part.

Figure 5:
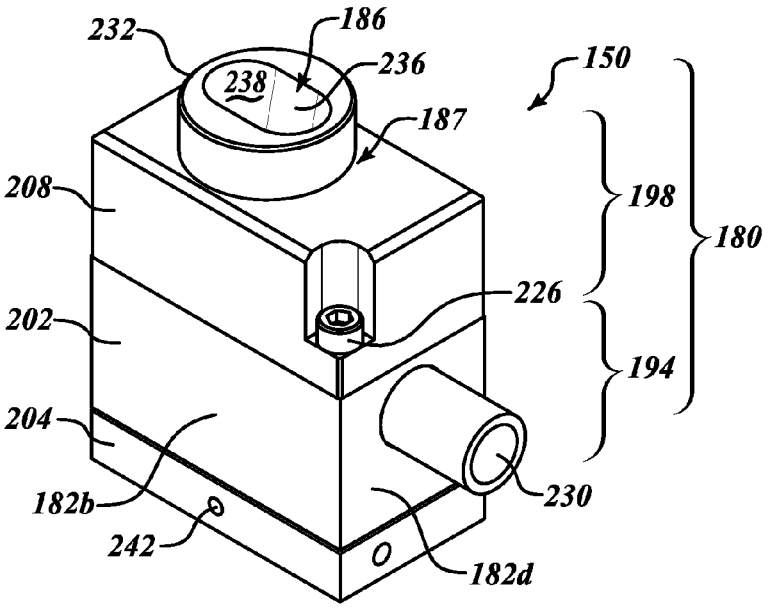
FIG. 5 is an isometric view of a fluid jet receiving receptacle, according to another embodiment.
Figure 6:
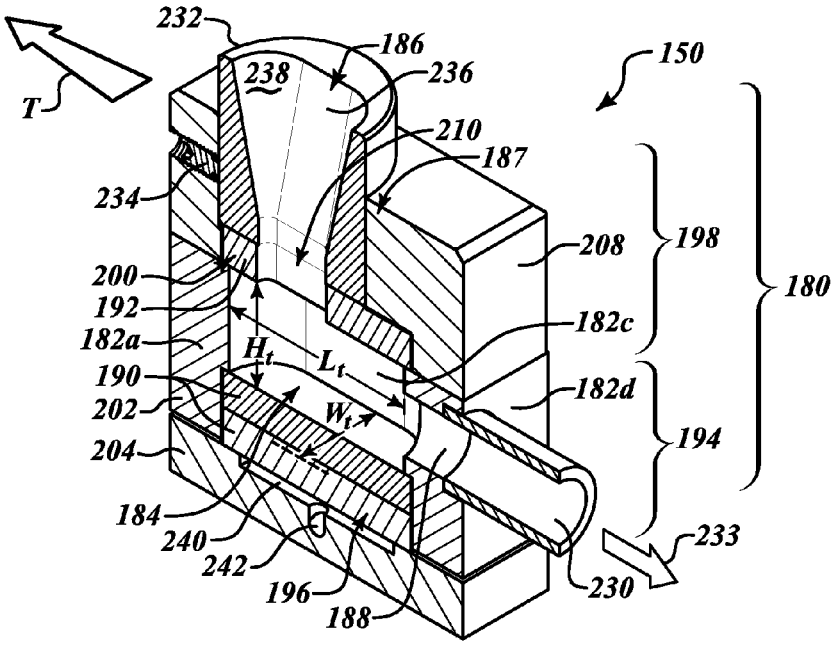
FIG. 6 is an isometric cross-sectional view of the fluid jet receiving receptacle of FIG. 5 taken along line 5-5.
Figure 7:
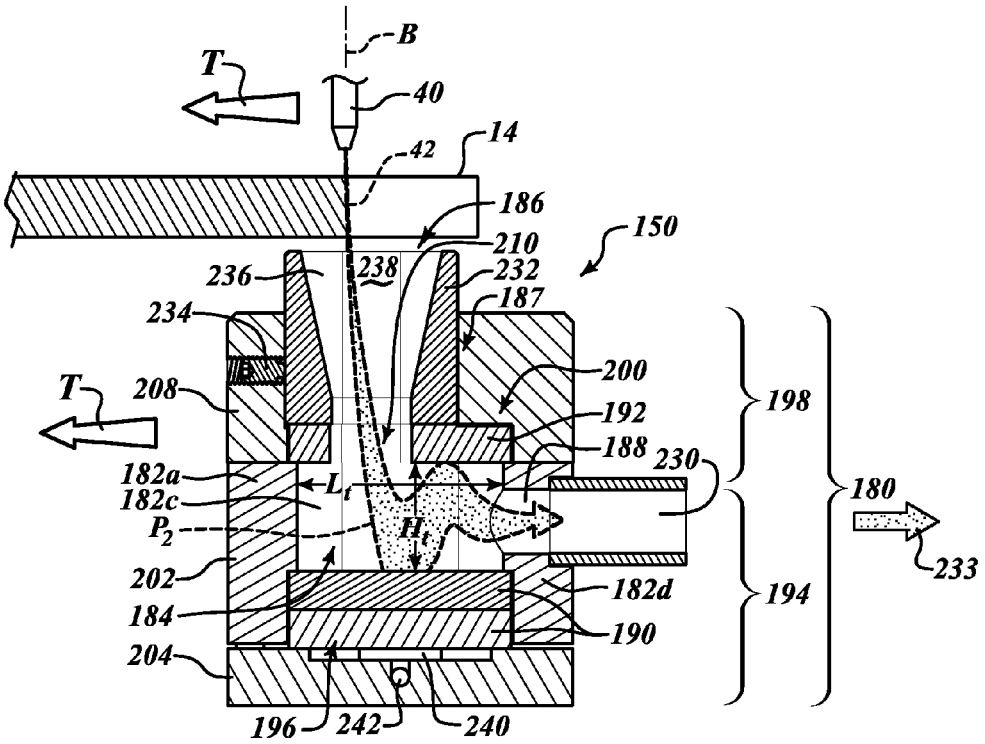
FIG. 7 is a cross-sectional elevational view of the fluid jet receiving receptacle of FIG. 5 taken along line 5-5 with the fluid jet receiving receptacle coupled to and positioned opposite a nozzle of a waterjet cutting head and with a workpiece positioned therebetween.

FIGS. 5 through 7 illustrate another example embodiment of a jet receiving receptacle 150 which is configured to couple to and be positioned opposite a waterjet cutting head 22 of the waterjet cutting system 10 of FIG. 1 to receive the jet in both non-deflected and deflected states during cutting operations.

As shown in FIGS. 5 through 7, the jet receiving receptacle 150 may include a housing 180 having sidewalls 182*a-d* and an internal cavity 184. An inlet 186 is provided within the housing 180 to provide access into the interior cavity 184. The inlet 186 may be elongated with respect to a direction of travel T (FIGS. 6 and 7) of the cutting head 22 and jet receiving receptacle 150 in embodiments wherein the workpiece 14 is supported in a static manner and the cutting head 22 and jet receiving receptacle 150 are manipulated in space relative thereto. In some embodiments, the inlet 186 is a slender, elongated oval or rectangular shaped aperture which allows a jet 42 discharged from the nozzle 40 of the cutting head 22 to enter into the housing 80 in an initial state which is generally collinear with the nozzle 40 and in a deflected state which is caused by the jet 42 passing through the workpiece 14 during processing operations in the direction of travel T.

The inlet 186 may be formed in a separate inlet feed component 232 which is coupled to the housing 180. The inlet feed component 232 may be removably coupled to the housing 180 within a cavity 187 thereof and secured thereto with a set screw 234 or other device. The inlet 186 may be defined by a passageway 236 extending through the inlet feed component 232. At least a portion of the passageway 236 may constrict in the downstream direction to define a jet receiving surface 238 which narrows or tapers to funnel contents of the jet 42 downstream. Each of an upper and a lower cross-sectional profile of the passageway 236 which defines the inlet 186 may be oval and elongated in the direction of travel T with the downstream end of the passageway 236 being smaller than the upstream end of the passageway 236. Although the inlet 186 shown in FIGS. 5 through 7 is portrayed as having an elongated, oval cross-sectional profile which tapers in the downstream direction, it is appreciated in other embodiments that the cross-sectional profile may be of different shapes and may vary over a length of the passageway 236. For instance, in one embodiment, the inlet 186 may have a generally circular cross-sectional profile which tapers in the downstream direction to form a conical jet receiving surface. Portions of the inlet 186 may also include straight walled sections or sections which diverge in the downstream direction. Inlet feed components 232 having different inlet configurations may be interchangeably received by the housing 180 to facilitate different cutting activities.

As can be appreciated from FIG. 7, the jet receiving receptacle 150 may be coupled to the cutting head 22 such that an axis B of the nozzle 40 is aligned to a leading end of the inlet 186. Accordingly, during operation, a fluid jet 42 may enter the inlet 186 at the leading end in a non-deflected state and fan out toward an opposing end of the inlet 186 in a deflected state when the fluid jet cuts a workpiece 14 while moving in the travel direction T. The jet receiving receptacle 150 may be manipulated in space in unison with the nozzle 40 such that the inlet 186 is maintained in general alignment with the travel direction T of the nozzle 40 to receive the fluid jet 42 from the nozzle 40 in the deflected state throughout a cutting operation. The amount of deflection will depend on a variety of factors, including in particular the speed of the travel and the material being cut in terms of thickness and hardness, among other properties.

An outlet passage or discharge port 188 is also provided within the housing 180 to enable contents of the jet 42 captured by the jet receiving receptacle 150 to be routed out of the housing 180 to be discarded, recycled and/or reused as desired. In the embodiment of the jet receiving receptacle 150 shown in FIGS. 5 through 7, the discharge port 188 is located on one of the sidewalls 182*d*. More particularly, the discharge port 188 is located on a sidewall 182*d* which is on the trailing side of the fluid jet receiving receptacle 150 with respect to the direction of travel T. Although only a single discharge port 188 is shown in FIGS. 5 through 7, in other embodiments, more than one discharge port 188 may be provided in one or more sidewalls 182*a-d* and used separately or simultaneously to route the contents of the captured jet 42 away from the jet receiving receptacle 150.

With continued reference to FIGS. 5 through 7, the housing 180 is configured to support a jet deflection device 190 downstream of the inlet 186 to receive and redirect a portion of the jet 42 to impinge on a jet rebound device 192 upstream of the jet deflection device 190 during workpiece processing operations. For this purpose, the housing 180 may include a lower housing portion 194 with a cavity 196 to receive and rigidly support the jet deflection device 190 and an upper housing portion 198 with a cavity 200 to receive and rigidly support the jet rebound device 192.

As shown in FIGS. 6 and 7, the lower housing portion 194 may be provided with a cavity 196 that is sized and shaped to receive a jet deflection device 190 in the form of a series of planar structures, such as, for example, a pair of planar plates. The jet deflection device 190 may be removably coupled within the cavity 196 of the lower housing portion 194, such as, for example, by sandwiching the jet deflection device 190 between portions of the housing 180. More particularly, the jet deflection device 190 may be removably sandwiched between a main body component 202 and an end cap 204 of the housing 180. In this manner, the jet deflection device 190 may be conveniently removed from the housing 180 and replaced when the jet deflection device 190 becomes excessively worn from the jet 42 impinging thereon. The sidewalls 182*a-d* of the housing 180 may provide a limit or stop for the jet deflection device 190 when installed in the housing 180. In some embodiments, the jet deflection device 190 may comprise a plurality of stacked plates made of tungsten carbide or materials of comparable or greater hardness to prolong the life of the jet deflection device 190.

As shown in FIGS. 6 and 7, a breakthrough detector chamber 240 and associated port 242 may be provided downstream of the jet deflection device 190 to sense a condition in which the jet 42 breaks through the jet deflection device 190. A signal may be provided upon the breakthrough condition to prompt replacement of the jet deflection device 190 or portions or components thereof. In some embodiments, the system 10 may be controlled to stop cutting or to shut down in response to the breakthrough condition.

As shown in FIGS. 6 and 7, the upper housing portion 198 may be provided with a cavity 200 that is adapted to receive or otherwise house a jet rebound device 192 in the form of a planar structure, such as a plate or disc. The jet rebound device 192 may be removably coupled to the upper housing portion 198, such as, for example, by sandwiching the jet rebound device 192 between portions of the housing 180. For example, the jet rebound device 192 may be sandwiched between a main body component 202 and an end cap 208 and of the housing 180. In this manner, the jet rebound device 192 may be conveniently removed from the housing 180 and replaced when the jet rebound device 192 becomes excessively worn from the jet 42 passing through the jet rebound device 192 and/or rebounding onto the jet rebound device 192 after deflecting off the jet deflection device 190. In some instances, the jet rebound device 192 may be slidably removable from the fluid jet receiving receptacle 150 from an exterior thereof. The sidewalls 182*a-d* of the housing 180 may provide a limit or stop for the jet rebound device 192 when installed in the housing 180. In some embodiments, the jet rebound device 192 may comprise a material that is the same or similar to a material of the jet deflection device 190 which deflects the incoming jet to impinge on the jet rebound device 192. For instance, the jet rebound device 192 and the jet deflection device 190 may each comprise tungsten carbide or materials having comparable or greater hardness.

With continued reference to FIGS. 6 and 7, the jet rebound device 192 may include a jet aperture 210 which is sized and shaped similar to a downstream portion of the inlet 186 to enable the jet 42 to pass therethrough with little or no obstruction while simultaneously shielding the contents of the jet 42 from rebounding back upstream and out of the fluid jet receiving receptacle 150. In some embodiments, a profile of the jet aperture 210 of jet rebound device 192 is slightly greater than an initial profile of the narrowest portion of inlet 186 of the jet receiving receptacle 150. In some embodiments, a profile of the jet aperture 210 of the jet rebound device 192 is about the same size and shape as the narrowest portion of the inlet 186 of the jet receiving receptacle 150. The jet aperture 210 of the jet rebound device 192 may form a portion of the inlet 186 of the jet receiving receptacle 150.

With continued reference to FIGS. 6 and 7, the jet rebound device 192 is generally parallel to and offset from the jet deflection device 190 to create, in combination with the sidewalls 182*a-d* of the housing 180, a trap to receive the jet 42 discharged from the nozzle 40 during a workpiece processing operation. A representative path $P_2$ of the jet 42 through the trap is shown in FIG. 7. The path $P_2$ illustrates the nature of the jet 42 being in a deflected state as it exits from the workpiece 14, enters the inlet 186 and passes through the jet aperture 210 in the jet rebound device 192 and moves toward the trap. After passing through the jet rebound device 192, the jet 42 impacts the jet deflection device 190 and is deflected such that a substantial portion or a majority of the jet moves back toward the upper housing portion 198 to impinge on the jet rebound device 192 positioned upstream of the jet deflection device 190. The structure of the jet rebound device 192, however, substantially prevents the jet 42 from continuing toward the inlet 186 and instead diverts the deflected jet 42 generally away from the inlet 186 for eventual discharge through the discharge port 188. In some embodiments, a substantial portion or a majority of the contents of the jet 42 is deflected by the jet deflection device 190 to impinge directly on the jet rebound device 192 without encountering any intermediate structures. In some embodiments, a substantial portion or a majority of the contents of the jet 42 is deflected by the jet deflection device 190 to impinge directly on the jet rebound device 192 in the vicinity of the jet aperture 210 of the jet rebound device 192.

In some embodiments, the height $H_t$ of the trap formed between the jet rebound device 192 and the jet deflection device 190 is less than a length $L_t$ of the trap. In addition, the width $W_t$ of the trap may be less than the length $L_t$ of the trap. In some embodiments, both the height $H_t$ and the width $W_t$ of the trap are at least thirty percent less than the length $L_t$ of the trap, thereby defining a generally elongated trap. The trap may be elongated in the direction from a leading sidewall 182*a* of the jet receiving receptacle 150 to the trailing sidewall 182*d*. In some instances, the trap may form a slender, elongated, generally rectangular volume or an oval column which is elongated in the travel direction T. Irrespective of the size and shape of the trap, however, the trap provides wear structures (i.e., the jet deflection device 190 and the jet rebound device 192) on opposing ends of a chamber which collectively catch substantially the entirety of the contents of the fluid jet 42 in a relatively confined space and route the contents toward the discharge port 188. According to some embodiments, the trap may be vacant with the exception of the contents of the jet 42. In other embodiments, jet arresting or energy dissipating devices (not shown) may be provided within the trap to further dissipate the energy of the incoming jet 42 prior to discharge from the jet receiving receptacle 150.

The housing 80 of the jet receiving receptacle 150 may comprise a plurality of separately joinable housing components. For instance, as shown in the example embodiment of FIGS. 5 through 7, the housing 180 may comprise three separate components which join together to form the internal cavity 184 and to support the jet deflection device 190 and jet rebound device 192 therein. More particularly, a main body component 202 and opposing end caps 204, 208 may be joined together with one or more fasteners 226 or other devices.

The main body component 202 may include the sidewalls 182*a-d* and define at least a portion of the internal cavity 184. In addition, the main body component 202 may include the discharge port 188 and a threaded connection or other coupling feature, such as, for example, a stepped section, to receive a discharge fitting or adapter 230 to couple the housing 180 to a discharge conduit (not shown) for routing the contents of the fluid jet 42 away from the receptacle 150, as represented by the arrow labeled 233. The upstream end cap 208 may enclose the upstream end of the receptacle 150 and may include a cavity 187 to removably receive the inlet feed component 232 having the inlet 186 formed therein. Furthermore, the upstream end cap 208 may be removably coupled to the main body component 202 to provide access to the internal cavity 184 and the jet rebound device 192. In a similar manner, the downstream end cap 204 may enclose the downstream end of the receptacle 150 and may include the breakthrough detection port 242 and a cavity that forms at least a portion of the breakthrough detection chamber 240 in the assembled housing 180. Furthermore, the downstream end cap 204 may be removably coupled to the main body component 202 to provide access to the internal cavity 184 and the jet deflection device 190. It is appreciated, however, that in other embodiments, the housing 180 may include more or fewer components. For instance, in some embodiments, the housing 180 may be cast or otherwise formed as a single unitary part. It is also appreciated that in some embodiments, a portion of the housing 180, such as, for example, the downstream end cap 204, may function as the jet deflection device 190 and a portion of the housing 180, such as, for example, the upstream end cap 208, may function as the jet rebound device 192. In such embodiments, the end caps 204, 208 may comprise a relatively hard material such as, for example, tungsten carbide or the like.

Figure 8:
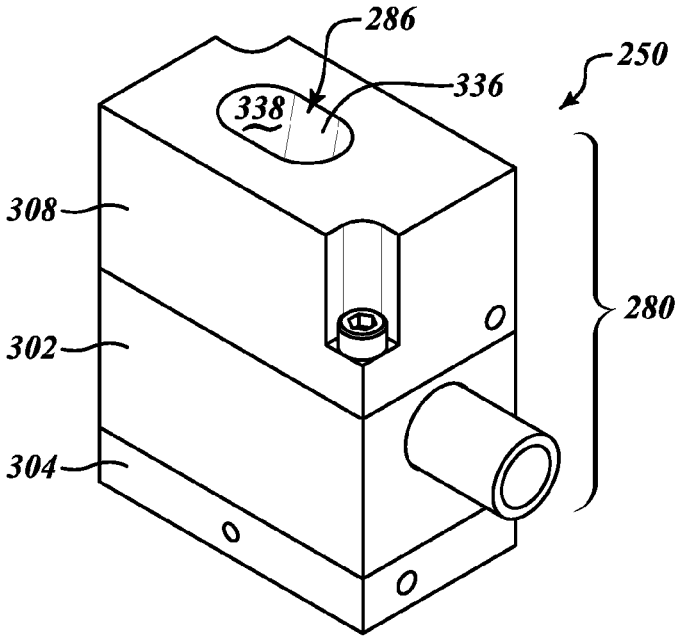
FIG. 8 is an isometric view of a fluid jet receiving receptacle, according to yet another embodiment.
Figure 9:
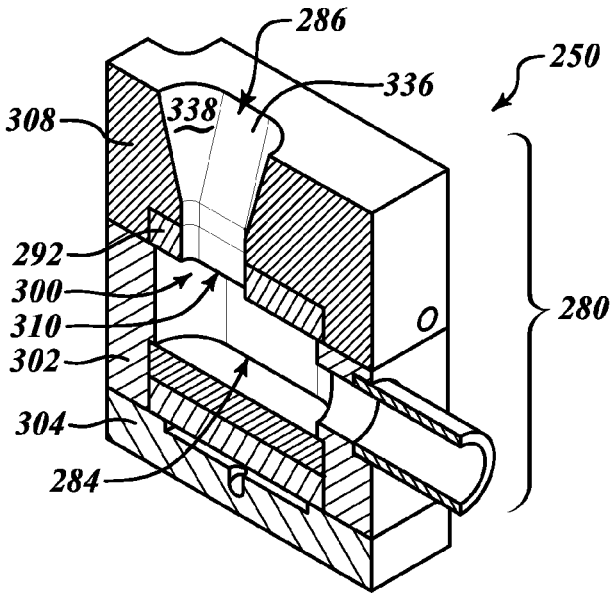
FIG. 9 is an isometric cross-sectional view of the fluid jet receiving receptacle of FIG. 8 taken along line 9-9.

It is still further appreciated that, according to some embodiments, a portion of the housing 180 may form at least a portion of the inlet 186 in lieu of including a separate inlet feed component 232. For example, FIGS. 8 and 9 illustrate another embodiment of a jet receiving receptacle 250 wherein an inlet 286 is formed directly in a portion of a housing 280 thereof. More particularly, the jet receiving receptacle 250 includes a housing 280 having a main body component 302 disposed between opposing end caps 304, 308. The upstream end cap 308 includes a cavity 300 to receive a jet rebound device 292 in the form of a planar plate or disc and includes an inlet passage 336 that defines at least a portion of the inlet 286 to the internal cavity 284 of the housing 280. The passage 336 includes a portion that defines a tapered jet receiving surface 338 that is configured to funnel the jet 42 downstream. The passage 336 is aligned with a corresponding jet aperture 310 in the jet rebound device 292 to provide access to the internal cavity 284 of the housing 280. The cross-sectional profile of the passage 336 is elongated in the direction of travel and may be generally oval in shape throughout the entirety of the passage. The passage 336 may constrict to a relatively narrow slit or window such that rebounding contents of the jet 42 are substantially blocked or prevented from exiting the receptacle 250 through the inlet 286. This advantageously reduces the occurrence of damage or impairment to the workpiece that might otherwise occur from rebounding contents of the jet 42.

Figure 10:
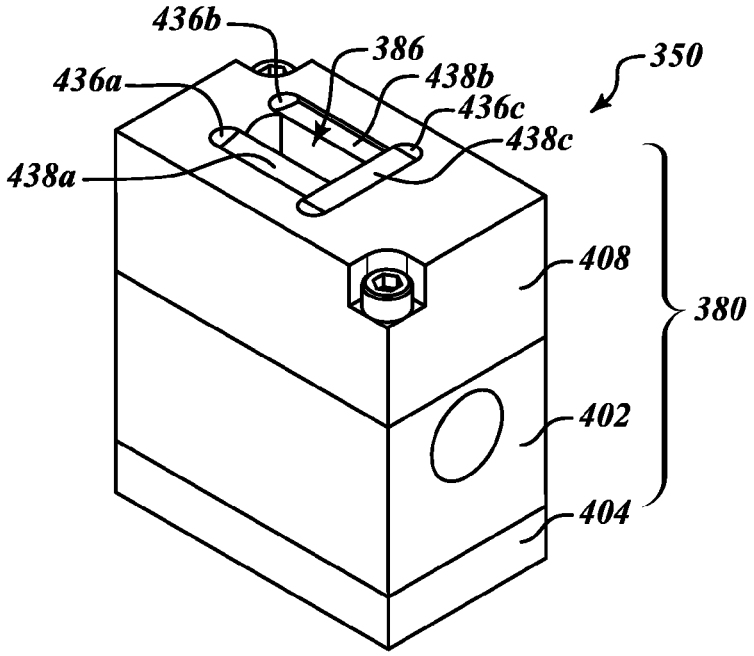
FIG. 10 is an isometric view of a fluid jet receiving receptacle, according to yet another embodiment.
Figure 11:
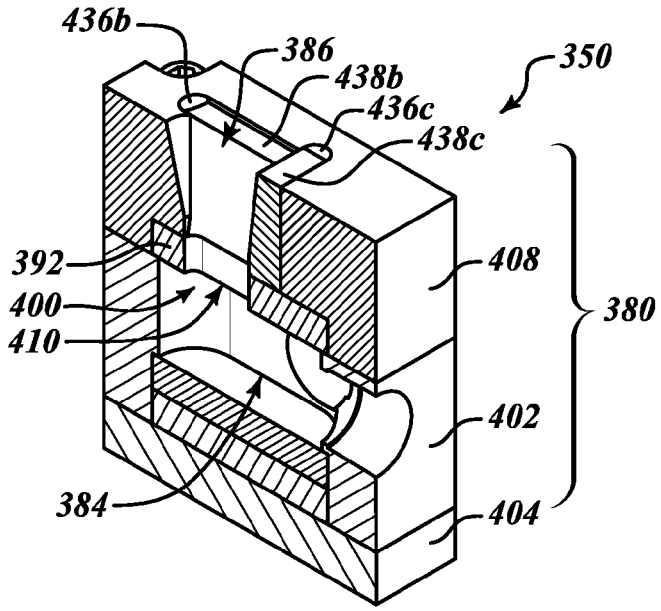
FIG. 11 is an isometric cross-sectional view of the fluid jet receiving receptacle of FIG. 10 taken along line 11-11.

FIGS. 10 and 11 illustrate yet another example embodiment of a jet receiving receptacle 350 which is configured to couple to and be positioned opposite a waterjet cutting head 22 of the waterjet cutting system 10 of FIG. 1. The jet receiving receptacle 350 of this example embodiment also includes a housing 380 having a main body component 402 disposed between opposing end caps 404, 408. The upstream end cap 408 includes a cavity 400 to receive a jet rebound device 392 in the form of a planar plate or disc and includes an arrangement of insert receiving features 436*a-c* to removably receive a plurality of inserts 438*a-c* which collectively define an inlet 386. The inserts 438*a-c* may be arranged such that opposing side inserts 438*a*, 438*b* are inclined toward each other to taper the inlet 386 in a downstream direction. Another insert 438*c* may be positioned adjacent the opposing side inserts to define a trailing portion of the inlet 386. Collectively, the inserts 438*a-c* may define a slender wedge-shaped inlet 386. The inlet 386 is aligned with a corresponding jet aperture 410 in the jet rebound device 392 to provide access to the internal cavity 384 of the housing 380. The inlet 386 may constrict to a relatively narrow slit or window such that rebounding contents of the jet 42 are substantially blocked or prevented from exiting the receptacle 350 through the inlet 386.

The various features and aspects described herein provide waterjet cutting systems 10 that are particularly well suited for processing workpieces 14 in an efficient manner and include jet receiving receptacles 50, 150, 250, 350 with compact and durable form factors to enable, among other things, processing workpieces 14 under limited clearance conditions and with a low occurrence of rebounding fluid and abrasives from the fluid jet receiving receptacle 50, 150, 250, 350. In addition, disclosed embodiments include generally elongated inlets that facilitate a wide range of jet deflection to advantageously provide for enhanced cutting speeds when compared to conventional jet receiving receptacle devices.

Although embodiments are shown in the figures in the context of processing a generic sheet-like workpiece 14, it is appreciated that the cutting head assemblies 70, fluid jet receiving receptacles 50, 150, 250, 350 and waterjet cutting systems 10 incorporating the same described herein may be used to process a wide variety of workpieces having simple and complex shapes, including both planar and non-planar structures. Example workpieces include stringers and other components for aircrafts. Furthermore, as can be appreciated from the above descriptions, the cutting head assemblies 70, fluid jet receiving receptacles 50, 150, 250, 350, and waterjet cutting systems 10 described herein are specifically adapted to generate a high-pressure or ultrahigh-pressure fluid jet and capture the same in a relatively compact form factor or package that is particularly durable and which can substantially reduce or effectively eliminate rebounding of fluid and abrasives from the fluid jet receiving receptacle 50, 150, 250, 350. This can be particularly advantageous when cutting, for example, high-precision composite parts for aircraft or the like which have particularly stringent quality controls. In addition, the compact nature of the fluid jet receiving receptacles 50, 150, 250, 350 can be particularly advantageous when cutting in confined spaces as is typical when cutting stringers of aircraft and the like.

Still further, although example embodiments are shown in the figures as including a generally rectangular housing 80, 180, 280, 380, it is appreciated that in some embodiments the housing may be generally cylindrical or of other regular or irregular shapes. In the case of cylindrical housings, it will be appreciated by those of skill in the relevant art that references herein to leading and trailing sidewalls, for example, correlate to leading and trailing portions of the cylindrical sidewall.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid jet system adapted to generate a fluid jet under high-pressure operating conditions to process a workpiece, the fluid jet system comprising:

a nozzle having a fluid jet outlet to discharge the fluid jet;

a jet receiving receptacle positioned opposite the nozzle to receive the fluid jet during a workpiece processing operation, the jet receiving receptacle including an elongated inlet aligned with a direction of travel of the nozzle to receive the fluid jet from the nozzle in a deflected state during the workpiece processing operation; and the jet receiving receptacle including a jet deflection device and a jet rebound device, the jet deflection device positioned downstream of the elongated inlet to receive and redirect a portion of the fluid jet to impinge on, the jet rebound device positioned upstream of the jet deflection device during the workpiece processing operation, the jet rebound device further including a series of spaced apart baffles disposed within the jet rebound device, each baffle of the series of baffles being slidably removable via the exterior of the jet rebound device.

2. The fluid jet system of claim 1 wherein the jet rebound device and the jet deflection device form opposing ends of a chamber to trap contents of the fluid jet and route the contents of the fluid jet away from the jet receiving receptacle during the workpiece processing operation.

3. The fluid jet system of claim 1 wherein the jet receiving receptacle includes a housing with an internal cavity and a discharge port, and wherein the jet deflection device, the jet rebound device and the internal cavity of the housing are configured to collectively trap contents of the fluid jet and route the contents of the fluid jet away from the jet receiving receptacle through the discharge port during the workpiece processing operation.

4. The fluid jet system of claim 1 wherein the jet receiving receptacle is coupled to move in unison with the nozzle by a rigid support arm, the rigid support arm shaped to define a workpiece clearance envelope between the nozzle and the jet receiving receptacle.

5. The fluid jet system of claim 1 wherein the jet receiving receptacle is configured to couple and move in unison with the nozzle in at least two primary orientations to facilitate processing workpieces with the elongated inlet in a first cutting orientation and with the elongated inlet in a second cutting orientation that is perpendicular to the first cutting orientation.

6. The fluid jet system of claim 1 wherein the jet receiving receptacle is configured to be manipulated in space in unison with the nozzle such that the elongated inlet is aligned with the direction of travel of the nozzle to receive the fluid jet from the nozzle in the deflected state during the workpiece processing operation.

7. The fluid jet system of claim 1 wherein the jet deflection device and the jet rebound device are planar structures having a material hardness equal to or greater than a hardness of tungsten carbide.

8. The fluid jet system of claim 1 wherein the jet rebound device includes at least one planar structure made of steel or aluminum.

9. A jet receiving receptacle coupleable to a high-pressure fluid jet system opposite a nozzle thereof to receive a fluid jet discharged from the nozzle during a workpiece processing operation, the jet receiving receptacle comprising:

an elongated inlet alignable with a direction of travel of the nozzle to receive the fluid jet from the nozzle in a deflected state during at least a portion of the workpiece processing operation;

a jet deflection device positioned downstream of the elongated inlet to redirect at least a portion of the fluid jet; and a jet rebound device located upstream of the jet deflection device to be impinged on by the redirected portion of the fluid jet, the jet rebound device further including a series of spaced apart baffles disposed within the jet rebound device, each baffle of the series of baffles being slidably removable via the exterior of the jet rebound device.

10. The jet receiving receptacle of claim 9, further comprising:

a housing with an internal cavity and a discharge port, and wherein the jet deflection device, the jet rebound device and the internal cavity of the housing are configured to collectively trap contents of the fluid jet and route the contents of the fluid jet away from the jet receiving receptacle through the discharge port during the workpiece processing operation.

11. The jet receiving receptacle of claim 9 wherein the jet rebound device includes an aperture that forms at least a portion of the elongated inlet of the jet receiving receptacle.

12. The jet receiving receptacle of claim 9 wherein the jet deflection device is positioned offset and generally parallel to the jet rebound device.

13. The jet receiving receptacle of claim 9 wherein the jet receiving receptacle includes a housing and wherein each baffle of the series of baffles terminate short of a sidewall of the housing to provide a space between the series of baffles and the sidewall.

14. The jet receiving receptacle of claim 9 wherein each baffle of the series of baffles comprises a material that is softer than a material of the jet deflection device.

15. The jet receiving receptacle of claim 9 wherein each baffle of the series of baffles includes an elongated aperture to generally align with the elongated inlet of the jet receiving receptacle.

16. The jet receiving receptacle of claim 15 wherein an initial profile of the elongated aperture of each baffle is within a profile of the elongated inlet of the jet receiving receptacle projected in a downstream direction.

17. The jet receiving receptacle of claim 15 wherein an initial width of the elongated aperture of each baffle is at least ten percent less than a width of a cross-sectional profile of a narrowest portion of the elongated inlet of the jet receiving receptacle.

18. The jet receiving receptacle of claim 9 wherein an end baffle of the series of baffles and the jet deflection device form a chamber to trap contents of the fluid jet and route the contents of the fluid jet away from the jet receiving receptacle during the workpiece processing operation.

19. The jet receiving receptacle of claim 9 wherein the jet receiving receptacle includes a housing and an inlet feed component separate from and removably coupled to the housing, at least a portion of the elongated inlet of the jet receiving receptacle being defined by an aperture of the inlet feed component.

20. The jet receiving receptacle of claim 19 wherein at least a portion of the aperture of the inlet feed component generally narrows in a downstream direction to funnel the fluid jet during the workpiece processing operation.

21. The jet receiving receptacle of claim 9 wherein the jet receiving receptacle includes a housing and wherein a portion of the housing forms the jet rebound device.

22. The jet receiving receptacle of claim 9 wherein the jet receiving receptacle includes a housing and wherein a portion of the housing forms the elongated inlet.

23. The jet receiving receptacle of claim 9, further comprising:

a breakthrough detector port downstream of the jet deflection device to sense a condition in which the fluid jet breaks through the jet deflection device.

24. The jet receiving receptacle of claim 9 wherein the jet deflection device includes a plurality of stacked plates.

25. The jet receiving receptacle of claim 9 wherein the jet receiving receptacle includes a housing and wherein the jet deflection device is removably coupled to the housing to enable removal and replacement of the jet deflection device from a downstream end of the housing.

26. The jet receiving receptacle of claim 9 wherein the jet receiving receptacle includes a housing and wherein the jet rebound device is removably coupled to the housing to enable removal and replacement of the jet rebound device.

27. The jet receiving receptacle of claim 9 wherein the elongated inlet of the jet receiving receptacle has a cross-sectional inlet profile that is oval, a major axis of the cross-sectional inlet profile being at least fifty percent greater than a minor axis of the cross-sectional inlet profile.

28. The jet receiving receptacle of claim 9, further comprising:

a housing including sidewalls and a discharge port, the housing defining a lower housing portion with a first cavity to receive and rigidly support the jet deflection device and an upper housing portion with a second cavity to receive and rigidly support the jet rebound device, wherein the jet deflection device comprises at least one planar jet deflection structure secured within the first cavity of the lower housing portion and the jet rebound device comprises at least one planar jet rebound structure secured within the second cavity of the upper housing portion; and wherein the at least one planar jet rebound structure is generally parallel to and offset from the at least one planar jet deflection structure to create, in combination with the sidewalls of the housing, a trap to receive the fluid jet discharged from the nozzle during the workpiece processing operation and to route contents of the fluid jet through the discharge port of the housing, a height of the trap between the at least one planar jet rebound structure and the at least one planar jet deflection structure and a width of the trap each being less than a length of the trap.

29. A jet receiving receptacle coupleable to a high-pressure fluid jet system opposite a nozzle thereof to receive a fluid jet discharged from the nozzle during a workpiece processing operation, the jet receiving receptacle comprising:

an elongated inlet alignable with a direction of travel of the nozzle to receive the fluid jet from the nozzle in a deflected state during at least a portion of the workpiece processing operation;

a jet deflection device positioned downstream of the elongated inlet to redirect at least a portion of the fluid jet;

a jet rebound device located upstream of the jet deflection device to be impinged on by the redirected portion of the fluid jet; and a breakthrough detector port downstream of the jet deflection device to sense a condition in which the fluid jet breaks through the jet deflection device.

30. A jet receiving receptacle coupleable to a high-pressure fluid jet system opposite a nozzle thereof to receive a fluid jet discharged from the nozzle during a workpiece processing operation, the jet receiving receptacle comprising:

an elongated inlet alignable with a direction of travel of the nozzle to receive the fluid jet from the nozzle in a deflected state during at least a portion of the workpiece processing operation, wherein the elongated inlet has a cross-sectional inlet profile that is oval, a major axis of the cross-sectional inlet profile being at least fifty percent greater than a minor axis of the cross-sectional inlet profile;

a jet deflection device positioned downstream of the elongated inlet to redirect at least a portion of the fluid jet; and a jet rebound device located upstream of the jet deflection device to be impinged on by the redirected portion of the fluid jet.

* * * * *